US008267306B2

(12) United States Patent
Bosselaers et al.

(10) Patent No.: US 8,267,306 B2
(45) Date of Patent: Sep. 18, 2012

(54) SELECTION SYSTEMS

(75) Inventors: Antoon Bosselaers, Mechelen (BE); Daniel De Cock, Kessel-Lo (BE); Bart Preneel, Leuven (BE); Frederik Vercauteren, Leefdaal (BE)

(73) Assignee: Katholieke Universiteit Leuven, K.U. Leuven R&D, Leuven (BE)

( * ) Notice: Subject to any disclaimer, the term of this patent is extended or adjusted under 35 U.S.C. 154(b) by 303 days.

(21) Appl. No.: 12/452,929

(22) PCT Filed: Jul. 31, 2008

(86) PCT No.: PCT/BE2008/000061

§ 371 (c)(1),
(2), (4) Date: Apr. 14, 2010

(87) PCT Pub. No.: WO2009/023939

PCT Pub. Date: Feb. 26, 2009

(65) Prior Publication Data

US 2010/0237151 A1 Sep. 23, 2010

(30) Foreign Application Priority Data

Jul. 31, 2007 (GB) ..... 0714908.1
Oct. 11, 2007 (GB) ..... 0719835.1
Oct. 11, 2007 (GB) ..... 0719838.5

(51) Int. Cl.
*G07C 13/00* (2006.01)

(52) U.S. Cl. ..... 235/51; 235/386

(58) Field of Classification Search ..... 235/51, 235/386; 705/12

See application file for complete search history.

(56) References Cited

U.S. PATENT DOCUMENTS

| | | | | |
|---|---|---|---|---|
| 7,690,566 | B2 * | 4/2010 | Quine et al. | 235/386 |
| 2002/0175514 | A1 | 11/2002 | Warther | |
| 2003/0015866 | A1 | 1/2003 | Cioffi et al. | |
| 2008/0035728 | A1 * | 2/2008 | Peterson | 235/386 |
| 2008/0179399 | A1 * | 7/2008 | Phillips | 235/386 |
| 2008/0308635 | A1 * | 12/2008 | Poulin et al. | 235/386 |

FOREIGN PATENT DOCUMENTS

| | | | |
|---|---|---|---|
| ES | 2 165 289 | A1 | 3/2002 |
| JP | 01 210395 | A | 8/1989 |
| WO | WO 2004/061599 | A | 7/2004 |
| WO | WO 2005/017822 | A | 2/2005 |
| WO | WO 2009/023939 | A2 | 2/2009 |

OTHER PUBLICATIONS

PCT International Search Report, PCT/BE2008/000061 dated Dec. 4, 2008.

* cited by examiner

*Primary Examiner* — Ahshik Kim
(74) *Attorney, Agent, or Firm* — TraskBritt, P.C.

(57) ABSTRACT

The present invention relates generally to a system and method to guarantee that a personal choice corresponds with an electronic encoding of this choice and, more particularly, to a system and method for its production, and allows the verification to a human that his or her choice has been taken into account which is easily auditable.

25 Claims, 4 Drawing Sheets

1. Claudia Fields
2. Mark Twain
3. Rachel Sheeley
4. Sherlock Holmes
5. Jack The Ripper

SELECTION SYSTEMS

CROSS-REFERENCE TO RELATED APPLICATIONS

This is a national phase entry under 35 U.S.C. §371 of International Patent Application PCT/BE2008/000061, filed Jul. 31, 2008, published in English as International Patent Publication WO 2009/023939 A2 on Feb. 26, 2009, which claims the benefit under Article 8 of the Patent Cooperation Treaty to Great Britain Patent Application Serial No. 0714908.1, filed Jul. 31, 2007, Great Britain Patent Application Serial No. 0719838.5, filed Oct. 11, 2007, and Great Britain Patent Application Serial No. 0719835.1, filed Oct. 11, 2007, the disclosure of each of the above-referenced priority documents is hereby incorporated herein by this reference in its entirety.

TECHNICAL FIELD

The present invention relates generally to an easily auditable system that allows participants of an election or selection process to verify that the system correctly encodes their personal choice. A particular embodiment of this system also allows the participants to verify that their choice has been taken into account in the election or selection process.

BACKGROUND

Problems related with the current state of art of electronic election and selection systems are:

1. A person cannot verify whether his/her choice is correctly encoded in an electronic election or voting system;
2. The system that processes a ballot may undetectably alter parts of the encoded information;
3. A person does not have the possibility to verify that his/her ballot was taken into account during the counting process.

Thus, there is a need in the art for the present invention as it deals with each of these issues: the person can verify whether his choice is correctly encoded; the parts used in the system are linked with one another to make undetectable alterations impossible; in a particular embodiment of the current invention, the person can even verify whether his choice was also taken into account during the counting process.

DEFINITIONS a "token" is something intended or supposed to represent or indicate another thing or a sign. A "ballot" is a token that represents a person's choice.

SUMMARY OF THE INVENTION

The present invention concerns a token comprising a zone [Z1] with a component for encoding a human's choice in a machine-readable representation and further comprising a zone [Z2] with a component for encoding the human's choice in a human-readable representation and a hiding means or component [Z3] to hide the zone with the human-readable representation, whereby the token is specially designed to operate a system that encodes the person's choice simultaneously with a human-readable representation and a machine-readable representation to protect the information against unauthorized disclosure or alteration of the person's choice after the person has confirmed his consent.

The hiding means [Z3] to hide the zone with the human-readable representation can be a cover, for instance, a semi transparent or not transparent sheet to cover the hiding zone and to render the human-readable representation unreadable. Such cover can be a removable adhesive layer or sheet. The term "machine-readable (or "computer-readable") representation" means information encoded in a form that can be read (i.e., scanned/sensed) by a machine/computer and interpreted by the machine's hardware and/or software. Common machine-readable data storage and data transmission components include processing waveforms, optical character recognition (OCR) and barcodes. Any information retrievable by any form of energy can be machine-readable. Examples include, for instance, magnetic storage, photochemical, electrical, semiconductor used in volatile RAM microchips, floating-gate transistor used in non-volatile memory cards, optical storage, thermodynamic, optics, etc.

In an alternative embodiment of the present invention, the token comprising a zone [Z1] for encoding a human's choice in a machine-readable representation and further comprising a zone [Z4] that encodes the human's choice in a visualized form on a second zone [Z5] or more zones that can only visualize the human-readable form of the person's choice after correctly matching the latter zones.

By such system, the human-readable and machine-readable representations can be encoded in a flexible or a hard zone of the token that is comprised in the token. Such token can be in full or partially be transparent, or in full or partially be opaque.

By the system of the present invention, the human-readable and machine-readable representations of the person's choice can be represented on one or more zones of the token. The token can be designed so that one or more zones of the token can hide other zones.

In yet an embodiment of the present invention, the token comprises one or more zones that comprise a resilient means or component to automatically reopen.

The resilient means is a component that allows automatic reopening or rebounding by the resilient material or returning to its original form or position after being bent. Suitable resilient means for the present invention comprise resilient materials, for instance, in sheet form such as elastomer sheets. In preferred embodiments, the resilient material includes one or more sheets of elastomers. Elastomers are polymers possessing elastic properties. Preferred elastomers include, but are not limited to, natural and synthetic rubbers such as styrene-butadiene rubbers, butyl rubbers, acrylonitrile-butadiene rubbers, polysulfide rubbers, latex, neoprene, polyurethanes, polyacrylate elastomers, silicone elastomers, fluoroelastomers, polyolefins such as ethylene-propylene elastomers, and polyvinyl chlorides. A single elastomer may be used, or a mixture or combination of two or more elastomers may be used.

Another specific embodiment of the present invention is a token comprising: 1) a zone [Z1] for encoding a human's choice in a machine-readable representation; 2) a zone [Z2] for encoding the human's choice in a human-readable representation; 3) a hiding means or component [Z3] to hide the zone with the human-readable representation; and 4) one or more zones [Z6] that can be separated from the token and kept by the person whose choice is represented with the token whereby such one or more zones [Z6] comprises an identifier [Z7] to identify the token from which it originates.

A specific embodiment of the present invention is a token comprising a zone [Z1] for encoding a human's choice in a machine-readable representation and further comprising a zone [Z4] that encodes the human's choice in a representation on two or more zones [Z5] that can only visualize the human-readable form of the person's choice after correctly matching the latter zones, whereby the token is specially designed for further processing in a system that encodes the person's choice simultaneously with a human-readable representation and a machine-readable representation to protect the information against unauthorized disclosure or alteration of the person's choice after the person has confirmed his consent.

Yet a more specific embodiment of the present invention is a token comprising: 1) a zone [Z1] for encoding a human's choice in a machine-readable representation; 2) a zone [Z2] for encoding the human's choice in a human-readable representation whereby the zone [Z2] for encoding the human's choice in a human-readable representation comprises a zone [Z4] that encodes the human's choice in a representation on two or more zones [Z5], which can only visualize the human-readable form of the person's choice after correctly matching the latter zones; 3) a hiding means or component [Z3] to hide the zone with the human-readable representation; and 4) one or more zones [Z6] that can be separated from the token and kept by the person whose choice is represented with the token whereby such one or more zones [Z6] comprises an identifier [Z7] to identify the token from which it originates, whereby the token is specially designed for further processing in a system that encodes the person's choice simultaneously with a human-readable representation and a machine-readable representation to protect the information against unauthorized disclosure of the person's choice after the person has confirmed his or her consent.

Particular embodiments on the tokens of the present invention are tokens in which the human-readable representation of the person's choice is hidden; in which one or more zones [Z6] comprise a sealing mechanism; in which the sealing mechanism comprises a sealing substance; in which the sealing substance is protected with a removable strip; wherein the integrity of the machine-readable representation of the person's choice is protected against unauthorized modifications; wherein the confidentiality of the machine-readable representation of the person's choice is protected against unauthorized access; wherein the integrity and the confidentiality of the machine-readable representation of the person's choice is protected against unauthorized access and modifications; that comprise one or more zones [Z7] that can identify the token; that comprise one or more zones that can be separated from the token; wherein one or more zones [Z6] that can be separated from the token identify the token [Z7]; wherein one or more parts that can be separated from the token can be kept by the person whose choice is represented with the token; wherein the part that can be separated from the token identifies the token from which it originates; whereby a part that is separatable from the token can be used to determine whether or not the token has been processed in the counting process of all the tokens.

Furthermore, the system of the present invention comprises embodiments wherein observers, participants or users of the system can access the tokens that have been cast; wherein identifying information of the tokens is published or wherein the published information can be queried by the observers, participants or users of the system.

The hardware that can be used to implement the current system of the present invention includes an off-the-shelf computer to help the human cast his/her choice, an off-the-shelf printer to print the token, an off-the-shelf reader to read the machine-readable representation of the person's choice, e.g., a barcode reader.

Furthermore, the present invention concerns a token comprising: 1) a zone [Z1] for encoding a human's choice in a machine-readable representation; 2) a zone [Z2] for encoding the human's choice in a human-readable representation; 3) a hiding means or component [Z3] to hide the zone with the human-readable representation; and 4) one or more zones [Z6] that can be separated from the token and kept by the person whose choice is represented with the token whereby such one or more zones [Z6] comprises an identifier [Z7] to identify the token from which it originates, whereby the token is specially designed for further processing in a system that encodes the person's choice simultaneously with a human-readable representation and a machine-readable representation to protect the information against unauthorized disclosure or alterations of the person's choice after the person has confirmed his or her consent and whereby the zone [Z2] for encoding the human's choice in a human-readable representation comprises a zone [Z4] that encodes the human's choice in a representation on two or more zones [Z5], which can only visualize the human-readable form of the person's choice after correctly matching the latter zones.

Specific embodiments of such tokens described above are as follows: In a particular embodiment, the token of the present invention has the human-readable and machine-readable representations encoded in a flexible or a hard zone of the token. In another particular embodiment of the present invention, such token is in full or in part transparent, or in full or in part opaque. In another embodiment, the human-readable and machine-readable representations of the person's choice are represented on one or more zones of the token. The token as described previously can have one or more zones to hide other zones. In a particular embodiment, such token comprises a resilient means or component to automatically reopen. The human-readable representation of the person's choice can be hidden. Therefore, one or more zones [Z6] in the token comprise a sealing mechanism. In a particular embodiment, such sealing mechanism comprises a sealing substance. Optionally, the sealing substance is protected with a removable strip. Such token can protect the integrity of the machine-readable representation of the person's choice against unauthorized modifications or such token can protect the confidentiality of the machine-readable representation of the person's choice against unauthorized access. In a particular embodiment, the hiding zones of the token protect the integrity and the confidentiality of the machine-readable representation of the person's choice against unauthorized access and modifications.

In yet another embodiment of the present invention, the previously described token comprises one or more zones [Z7] that can identify the token. Such one or more zones are specially designed that they can easily be separated from the token. Such one or more zones [Z6] that can be separated from the token allow identification of the token [Z7]. More particularly, the part(s) that can be separated from the token identify the token from which it originates. In particular, the token comprises one or more parts that can be separated from the token and kept by the person whose choice is represented with the token or the part that is separable from the token can be used to determine whether or not the token has been processed in the counting process of all the tokens.

Another embodiment of the present invention concerns a system for operating an election and protecting the information against unauthorized disclosure or alterations of the electing person's choice, characterized in that the system, when operational, encodes the person's choice simultaneously with a human-readable representation and a machine-readable representation on a token comprising a zone [Z1] for encoding a human's choice in a machine-readable representation and further comprising a zone [Z2] for encoding the human's choice in a human-readable representation and a hiding means or component [Z3] to hide the zone with the human-readable representation. Such system in a particular embodiment of the present invention further comprises means or components to cast the token and to provide that observers, participants or users of the system can access the tokens that have been cast after the electing person has confirmed his consent for such access. In a yet further embodiment, the present invention concerns such a system wherein the identifying information of the tokens is published and more in particular, the published information can be queried by the observers, participants or users of the system.

Yet another embodiment of the above-described system comprises an off-the-shelf computer to help the human cast his/her choice, an off-the-shelf printer to print the token, and an off-the-shelf reader to read the machine-readable representation of the person's choice, e.g., a barcode reader.

DETAILED DESCRIPTION OF THE INVENTION

Figure 1:
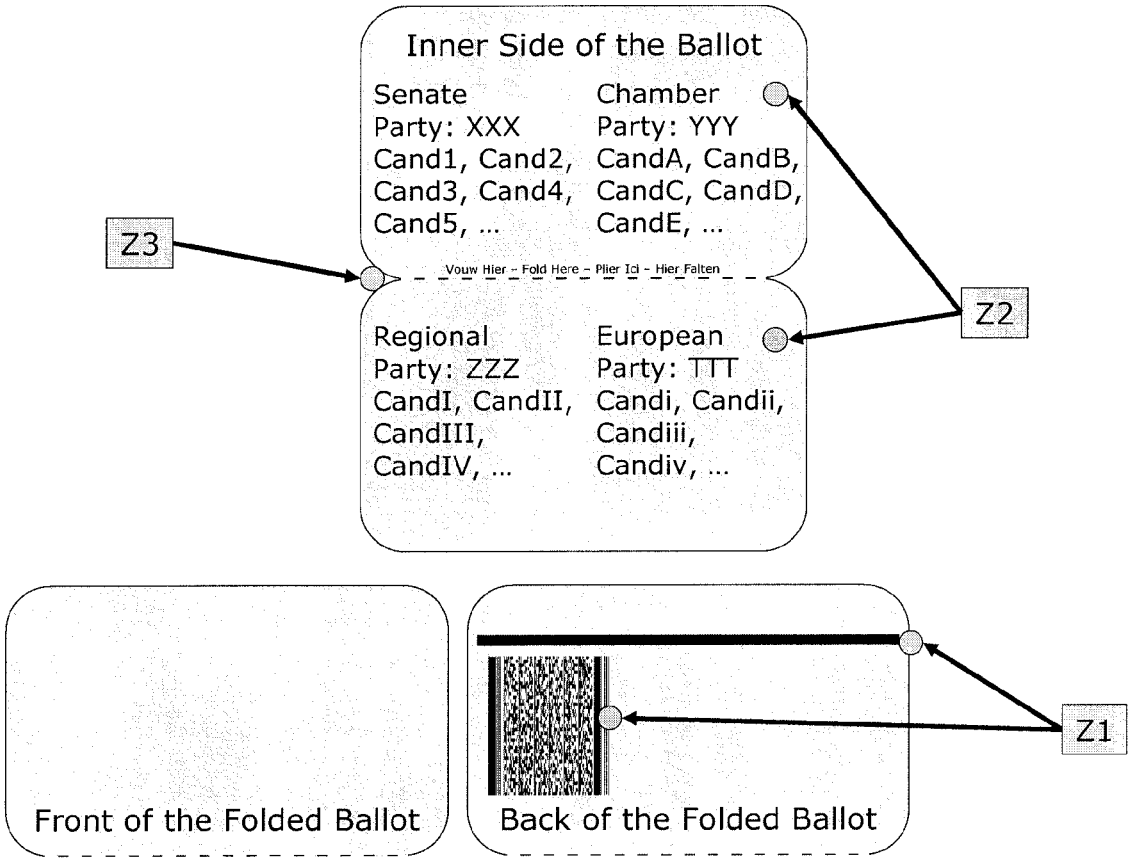
FIG. 1 provides an example embodiment of System 1 resulting in a booklet form. Top: inner part of the booklet listing the person's choice. Bottom: front and back of the ballot booklet when folded. The magnetic stripe and barcode digitally [Z1] represent the person's choice on the outer part of the ballot booklet, where the human-readable representation [Z2] is printed on its inner part.

Other embodiments of the invention will be apparent to those skilled in the art from consideration of the specification and practice of the invention disclosed herein. It is intended that the specification and examples be considered as exemplary only. For example, it is clear for the person skilled in the art that the present invention allows, but is not limited to, selection, election and voting systems, and that it can easily be used in any process and system of expression of a human's choice, e.g., instructions and decisions.

The systems comprise a token, e.g., a flexible sheet or a hard sheet with flexible zones, that is opaque or that is in full or partially transparent, including a machine-readable zone [Z1] that encodes the human's choice, and possibly including a zone to hide or seal [Z6] other parts of the token, in particular, to hide the part or parts [Z2] of the token encoding the human's choice that is also encoded on the token.

The input that leads to the token discussed below can be completed or produced in a privacy-enhanced environment, such as a voting booth.

The invention also concerns a template and the systems to complete the encoded tokens.

Each of these tokens includes a human-readable representation [Z2] and a machine-readable representation [Z1] of the human's choice. The first representation is used by the human to confirm that the token represents his/her choice. The machine-readable representation encodes the same information, and enhances the automatic processing of the tokens, e.g., counting or recounting of voting ballots.

Authorized parties can easily confirm that the information that is encoded in the machine-readable representation of the token, e.g., a barcode, a microprocessor chip, or a magnetic stripe, effectively corresponds with the human-readable representation of the token.

A particular embodiment of the present invention consists of a token that can be sealed to hide the human-readable representation of the person's choice. The zone [Z6] of the token that protects the sealing substance can be removed from the token by the person whose choice is encoded on this token, and can also be used to identify the token. If this is the case, the separated part can be used to confirm that the person's choice has effectively been taken into account.

Particular Advantages of the Systems:

System 1 guarantees that a person can easily confirm that the human-readable representation of the token corresponds with his/her choice.

System 2 further increases the transparency of the system by adding a sealing substance to the tokens.

System 3 allows a referee to confirm that a person has not added unwanted marks to the token without compromising the person's choice.

Systems 2 and 3 are transparency-enhanced systems. They enhance the transparency of the system by allowing the human who participated in the election system to confirm that his/her token was also taken into account during the counting process.

System 1—Basic System

- The person makes a selection using a selection device
- The token on which the person's choice is encoded can form a booklet.
- The booklet has two parts: an inner part and an outer part. The booklet can be produced using a single-sided or a duplex printing device.

The person's choice is visually printed in human-readable representation on the inner part of the token, e.g., a voting ballot in booklet form.

Figure 2:
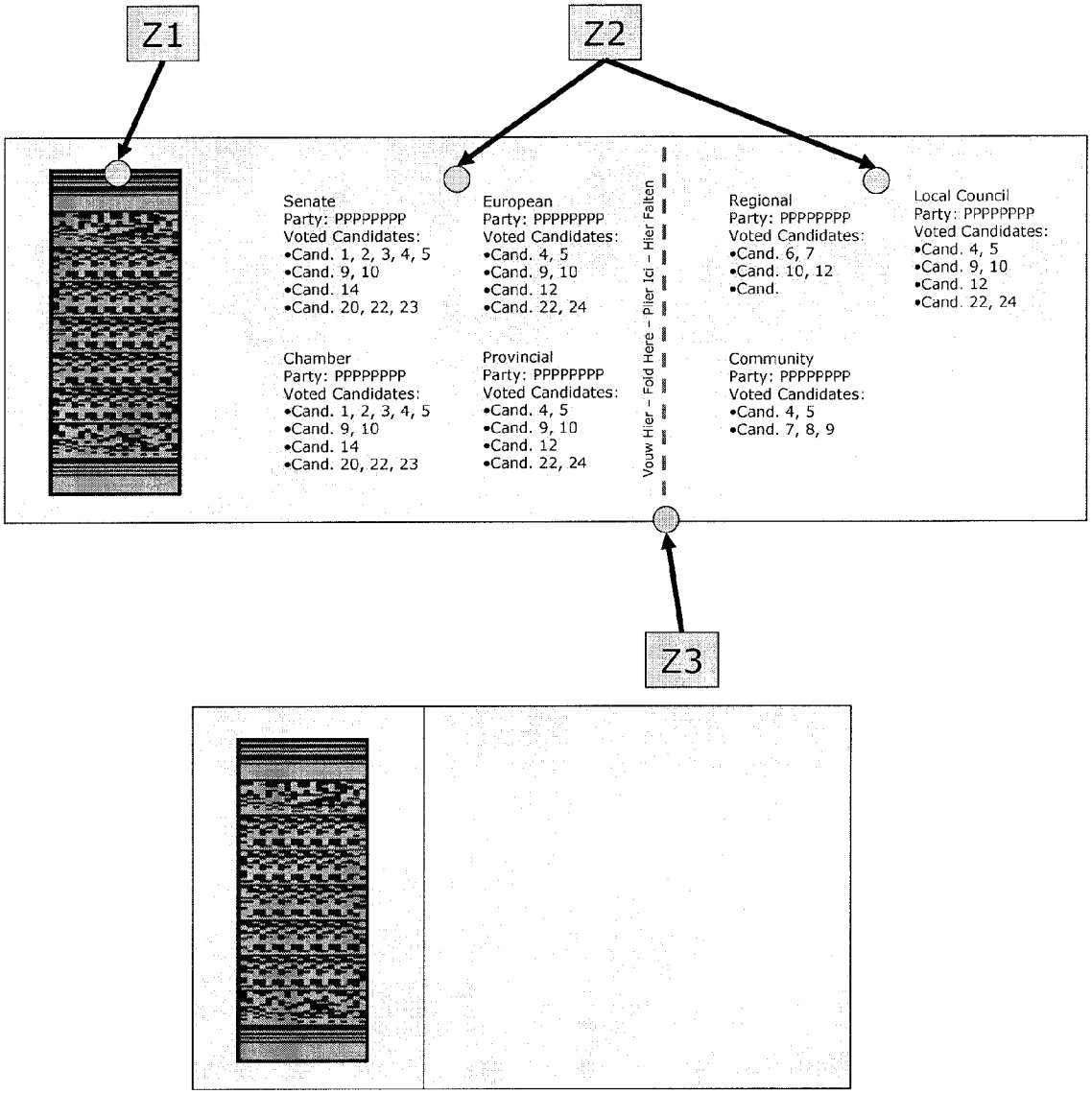
FIG. 2 provides an example embodiment of System 1 with three zones: a barcode [Z1], the left and right part of the human-readable representation [Z2] of the person's choice, separated by a foldable zone [Z3]. Top: unfolded ballot. Bottom: folded ballot.

- The outer part of the token comprises a machine-readable representation of the same information as the human-readable representation on the inner part of the booklet. The same information is encoded in each representation.
- Examples of a machine-readable representation that can be used to encode a person's choice on the outside of the token include magnetic stripes and barcodes.
- The token may comprise more than one machine-readable representation of the person's choice.
- The token may consist of a sealing substance that can be used to seal the human-readable representation of the token to prevent unauthorized disclosure of the person's choice.
- FIG. 1 shows an example of a possible embodiment token of this system in which both a magnetic stripe and a barcode are used on the outer part of the booklet to represent the person's choice.
- FIG. 2 shows a simplified version of another possible embodiment of this system in which the person's choice is encoded with a barcode in the zone for the machine-readable representation of the person's choice. The top part of the figure shows the unfolded ballot booklet, the bottom part shows the folded ballot booklet.

System 2—Transparency-Enhanced Variant of System 1.

A person's choice comprises of a token, in particular, a voting ballot, for instance, in booklet form, as in System 1.

The voting ballot comprises several parts:

1. A zone [Z1] with a machine-readable representation of the person's choice that can easily be registered by machine;
2. One or more optional zones [Z7] that uniquely identify the ballot;
3. A zone [Z2] where the person's choice is visually printed in human-readable form;
4. A zone [Z6] that optionally contains the same ballot identifying information as zone [Z7] to reveal the sealing substance or sealing mechanism. Zone [Z6] also comprises a sealing substance, e.g., a glue;
5. The sealing substance that protects unauthorized disclosure of the human-readable representation of the voter's choice in zones [Z2] after sealing.

The parts 2, 4 and 5 may also be restructured or combined, e.g., to facilitate the visual comparison of the identifying information [Z7] printed on parts 2 and 4.

Figure 3:
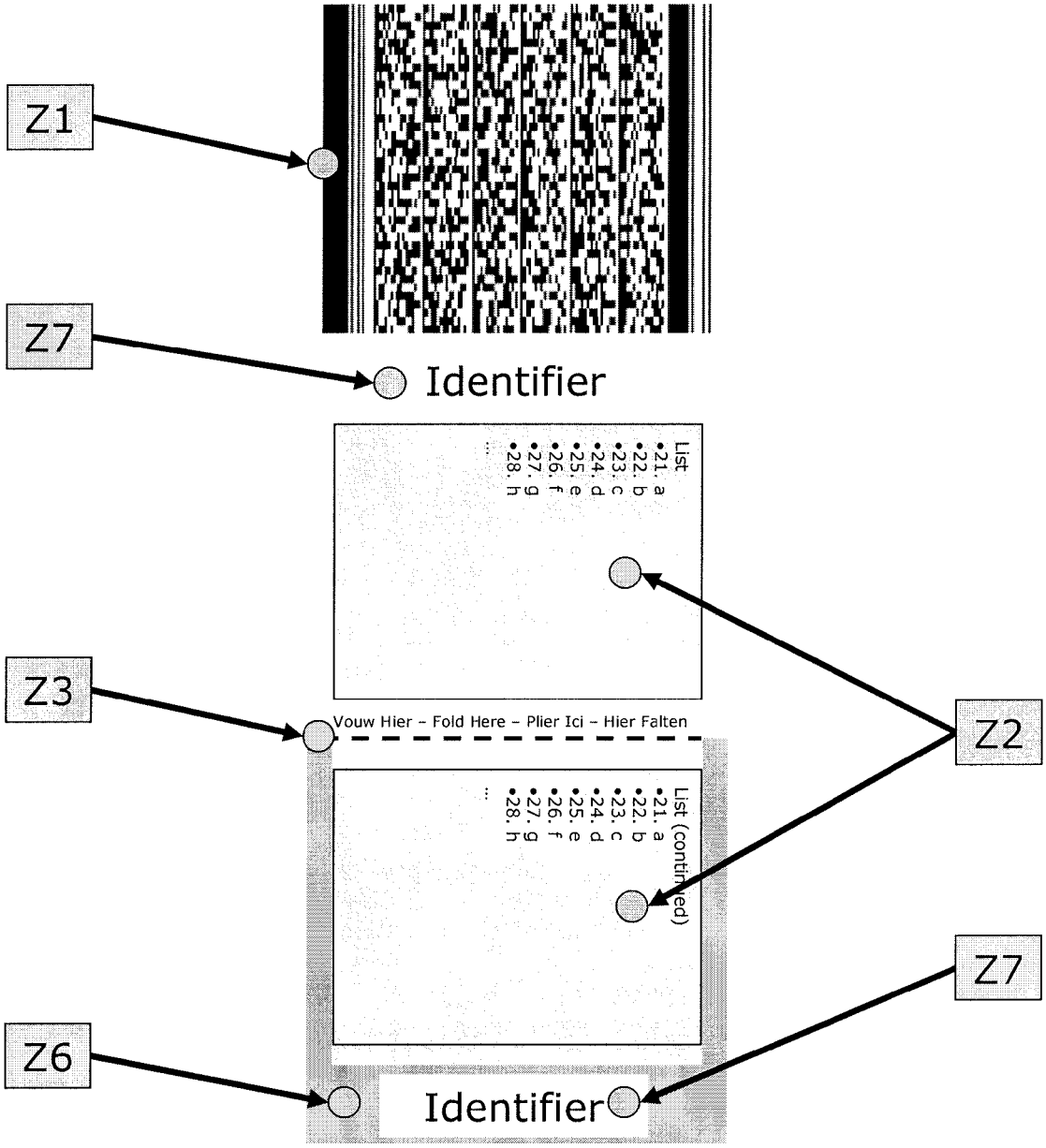
FIG. 3 provides an example embodiment of System 2 with different zones: [Z1], a machine-readable representation; [Z2], the human-readable representation of the person's choice; [Z3], a foldable zone; [Z6], a retractable seal that contains [Z7] an identifier of the ballot.

FIG. 3 shows an example of a possible embodiment token of System 2.

Examples of these parts:

Part 1. A barcode that encodes the information that is visually printed in Part 3 [Z1]. The information may be encrypted and/or integrity protected to prevent unauthorized disclosure or modification of the encoded information.

Part 2. Optional: a human-readable identifier [Z7] that identifies the information encoded in Part 1, e.g., a cryptographic hash, message authentication code, digital signature, or a combination of these.

Part 3. A human-readable representation [Z2] of the person's choice. This part represents the same information as encoded in Part 1. Part 3 may comprise a foldable zone [Z3] to enhance the ease of use of the system.

Part 4. The same identifiable information [Z7] as encoded in Part 2, but printed on a removable strip [Z6] that, in the preferred embodiment, reveals the sealing substance of Part 5.

Part 5. The sealing substance, e.g., a glue, preferably protected by a removable strip [Z6] as specified as Part 4.

System 3—Improved Version of System 2 Using Visual Cryptography

A person's choice is encoded in a token, in particular, a voting ballot, for instance, a partially transparent sheet.

The token comprises of the following parts:

Part 1. Identical to Part 1 of System 2.

Part 2. Two or more visual crypto parts in zone [Z4] that represent the person's choice. This choice can only be revealed when the visual crypto parts [Z5] are overlaid in a correct manner;

Part 3. An optional part [Z7] that identifies the token.

Part 2 may optionally comprise the following means or a combination thereof: (i) a flexible or foldable zone [Z3] to easily match the visual crypto parts. This foldable zone may also optionally comprise a resilient means or component to automatically reopen; (ii) anchors to ease the correct matching of the two visual crypto parts [Z5] in such a way that the encoded information becomes readable to confirm that the visualized information corresponds with the person's choice.

Figures 4, 5:
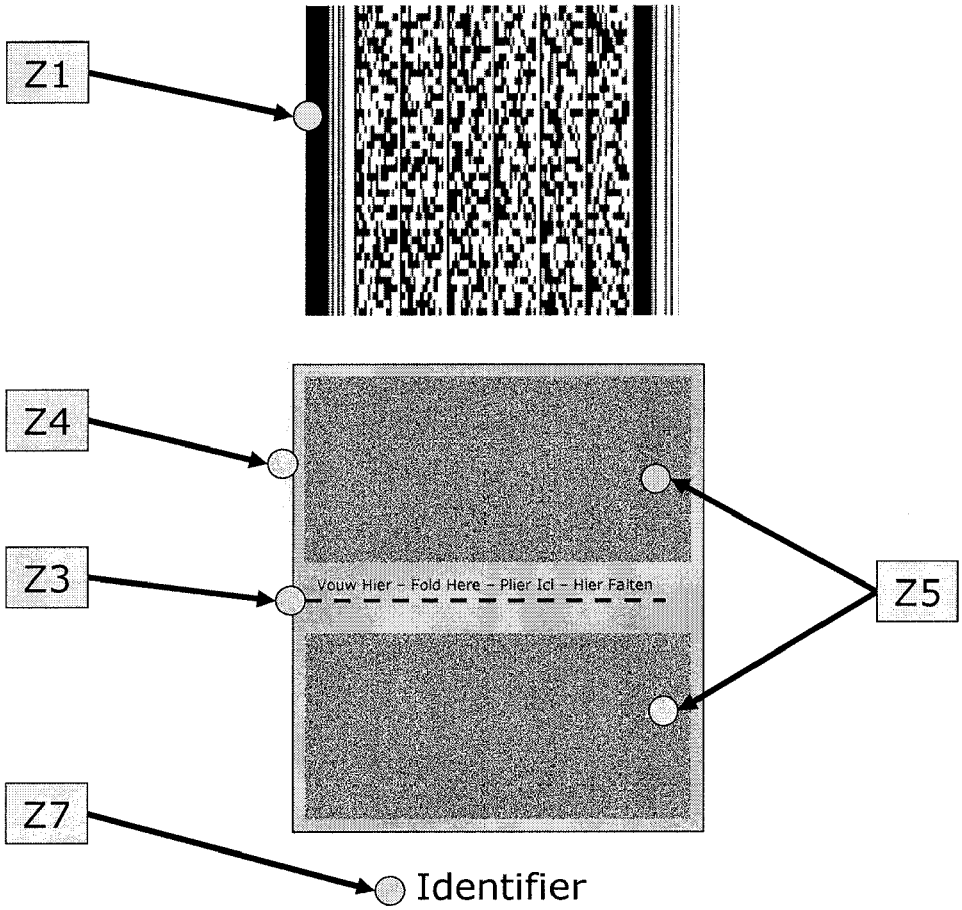
FIG. 4 visualizes the information encoded in [Z4] of FIG. 5.
FIG. 5 provides an example embodiment of System 3 with different zones: [Z1], a machine-readable representation of the person's choice; [Z7], an identifier of the ballot; [Z5], two visual crypto parts separated by a flexible zone [Z3] to help visualize the information shown in FIG. 4.

FIG. 4 shows the information that is encoded in Part 2 of FIG. 5, which gives an example of a possible embodiment token of System 3. Matching the visual crypto parts of Part 2 of the token reveals in this particular example the infoiination depicted in FIG. 4.

Examples of these parts:

Part 1. Identical to Part 1 of System 2.

Part 2. Two visual cryptography halves that must be correctly matched in order to reveal the person's choice. The revealed information enables the verification of Part 1.

Part 3. A cryptographic hash of the machine-readable representation of the person's choice.

The invention claimed is:

1. A token comprising:

a zone Z1 for encoding information of a human's choice in a machine-readable representation;

a zone Z2 for receiving a visual print of the same information of the human's choice in a human-readable representation;

a hiding component Z3 to hide the zone with the human-readable representation; and one or more zones Z6 that can be separated from the token and kept by the human whose choice is represented with the token, wherein said one or more zones Z6 comprise an identifier Z7 to receive information that identifies the information in the machine-readable representation so that it is verifiable that a choice is correctly encoded while the information is protected against unauthorized disclosure and unauthorized alteration of the human's choice after the human has confirmed his or her consent.

2. The token of claim 1, wherein the identifier Z7 is a zone for receiving a human-readable identifier that identifies the information of a human's choice encoded in the machine-readable representation and to identify the token from which it originates.

3. The token of claim 1, wherein the zone Z2 is a zone that encodes the human's choice in a representation on two or more zones that can only visualize the human-readable form of the human's choice after correctly matching other zones on the token.

4. The token of claim 1, wherein the human-readable and machine-readable representations are encoded in a flexible or a hard zone of the token.

5. The token of claim 1, wherein parts of the token are in full or in part transparent, or in full or in part opaque.

6. The token of claim 1, wherein the human-readable and machine-readable representations of the human's choice are represented on one or more zones of the token.

7. The token of claim 1, wherein one or more zones of the token can hide other zones.

8. The token of claim 1, wherein one or more zones of the token comprise a resilient component to automatically reopen the token in its original position after being bent.

9. The token of claim 1, wherein the human-readable representation of the human's choice is hidden.

10. The token of claim 1, which further comprises a zone with a sealing mechanism that protects unauthorized disclosure of the human-readable representation of the voter's choice in zone Z2 after sealing.

11. The token of claim 10, wherein the sealing mechanism comprises a sealing substance.

12. The token of claim 10, wherein the sealing substance is protected.

13. The token of claim 2, which further comprises a zone with a sealing substance that protects unauthorized disclosure of the human-readable representation of the voter's choice in zone Z2 after sealing.

14. The token of claim 13, wherein the sealing mechanism comprises a sealing substance.

15. The token of claim 13, wherein the sealing substance is protected.

16. The token of claim 3, which further comprises a zone with a sealing substance that protects unauthorized disclosure of the human-readable representation of the voter's choice in zone Z2 after sealing.

17. The token of claim 16, wherein the sealing mechanism comprises a sealing substance.

18. The token of claim 16, wherein the sealing substance is protected.

19. The token of claim 1, wherein the integrity of the machine-readable representation of the human's choice is protected against unauthorized modifications.

20. The token of claim 1, wherein the confidentiality of the machine-readable representation of the human's choice is protected against unauthorized access.

21. The token of claim 1, wherein integrity and confidentiality of the machine-readable representation of the human's choice is protected against unauthorized access and modifications.

22. The token of claim 1, that comprises one or more zones Z7 that can identify the token.

23. The token of claim 1, which comprises one or more zones that can be separated from the token.

24. The token of claim 1, wherein one or more zones Z6 can be separated from the token to identify the token.

25. The token of claim 1, wherein a part that can be separated from the token identifies the token from which it originates.

* * * * *